US005303812A

United States Patent [19]

Strasser et al.

[11] Patent Number: 5,303,812

[45] Date of Patent: Apr. 19, 1994

[54] DEVICE FOR TRANSFERRING TRANSPORT CONTAINERS FROM A LOADING STATION TO AN UNLOADING STATION

[75] Inventors: Karl-Heinz Strasser, Berg; Martin Röck, Tettnang, both of Fed. Rep. of Germany

[73] Assignee: Handtmann A-Punkt Automation GmbH, Baienfurt, Fed. Rep. of Germany

[21] Appl. No.: 33,814

[22] Filed: Mar. 19, 1993

[30] Foreign Application Priority Data

Mar. 21, 1992 [DE] Fed. Rep. of Germany ..... 4209238

[51] Int. Cl.[5] ..... B65G 25/00

[52] U.S. Cl. ..... 198/465.2; 198/345.3

[58] Field of Search ..... 198/345.2, 345.3, 465.1, 198/465.2, 464.2, 475.1, 803.01

[56] References Cited

U.S. PATENT DOCUMENTS

| | | | |
|---|---|---|---|
| 1,926,914 | 9/1933 | Popov | 198/465.2 X |
| 3,343,645 | 9/1967 | Doerfling | 198/345.2 |
| 3,595,368 | 7/1971 | Mantovani | 198/465.2 |
| 4,200,182 | 4/1980 | Siarto | 198/345.3 |
| 4,570,782 | 2/1986 | Largill et al. | 198/345.3 |
| 5,107,976 | 4/1992 | Strasser et al. | 198/345.3 |

FOREIGN PATENT DOCUMENTS

| | | | |
|---|---|---|---|
| 0895181 | 5/1962 | United Kingdom | 198/465.2 |

*Primary Examiner*—James R. Bidwell

*Attorney, Agent, or Firm*—Robert W. Becker & Associates

[57] ABSTRACT

A device for transferring transport containers in a controlled manner from a loading station to an unloading station includes a continuously rotatably driven transport wheel and a stationary brake ring that is positioned concentrically to the transport wheel. The transport containers are alternately coupled to the brake ring and the transport wheel. Support arms are concentrically rotatably supported relative to the transport wheel and each support arm carries one of the transport containers. The transport containers can be smoothly coupled to or decoupled from the transport wheel or the brake ring so that a gentle transport is provided. The transport containers during operation do not contact one another and do not slide unbraked onto an abutment, thereby providing a gentle treatment of the goods to be transported.

36 Claims, 6 Drawing Sheets

DEVICE FOR TRANSFERRING TRANSPORT CONTAINERS FROM A LOADING STATION TO AN UNLOADING STATION

BACKGROUND OF THE INVENTION

The invention relates to a device for a controlled transfer of transport containers from a loading station to an unloading station, especially for a packaging-suitable transfer of fresh or non-smoked sausages, portioned and shaped in a sausage filling machine, to a packaging machine, the device comprising a transport means to which the transport containers are controllably connectable.

From U.S. Pat. No. 5,107,976 a transport device of this kind for automatically transferring portioned sausages from a sausage filling machine to a packaging machine is known. The transport means is in the form of a horizontally arranged continuously driven transport wheel to which transport containers suspended from a carrier can be coupled or decoupled at will. The carrier is in the form of two rails arranged vertically above one another and spaced apart. The transport wheel is positioned between the rails.

This transport device has successfully been employed in practice; however, it is disadvantageous that the transport containers at the loading and unloading stations are suddenly braked by sliding onto abutments. This sudden braking of the transport containers not only results in a relatively high noise emission, but also in considerable vibrations of the transport containers and the goods contained therein so that occassionally the transport containers will open and the enclosed goods will fall out. Furthermore, because the transport containers are frictionally connected to the transport wheel it is necessary to observe high precision during manufacturing of the device components because otherwise the transport containers will not be properly engaged by the transport wheel. Also, the coupling processes, due to manufacturing tolerances and wear, often are not reproducible. Despite a considerable constructive expenditure the known transport device, which due to the great dimension of the transport wheel also requires very high drive energies, does not provide a sufficient operative reliability.

It is therefore an object of the present invention to provide a transport device with which it is possible not only to achieve the advantages of the known device, i.e., the automated transport and placing into a packaging container of a packaging machine of sausages portioned and shaped at a sausage filling machine without operating personnel handling the sausages, but also to provide for a very exact coupling and decoupling action of the transport containers during transfer as well as parking so that a gentle transport of the goods to be transferred is achieved. Furthermore, the constructive expenditure as well as the operating costs should remain low, and an adaptation of the operating speed of the two machines coupled by the transport device to one another should allow for a facile storage of transport containers within the transport device. A primary object of the present invention is that the transport containers during operation should not abut one another and should not slide onto an abutment without being slowed down so that the operating noise is reduced and at all times a gentle treatment of the goods to be transferred is ensured.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
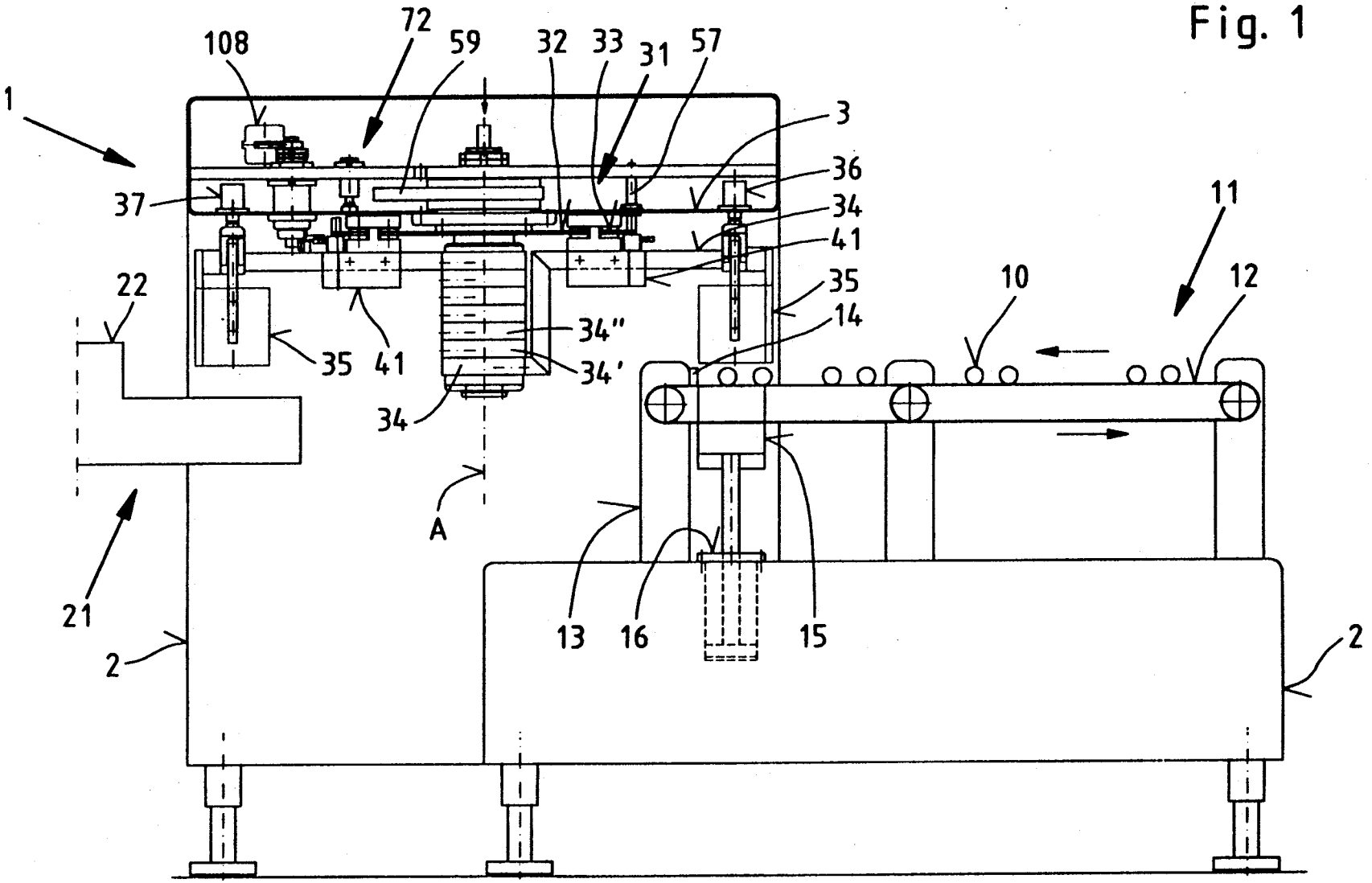
FIG. 1 shows a transport device in a side view.

The transport device for transferring transport containers in a controlled manner from a loading station to an unloading station according to the present invention is primarily characterized by: A transport means for transporting the transport containers between the loading station and the unloading station, wherein the transport containers are controllably connected to the transport means, the transport means comprising a continuously rotatable driven transport wheel and a stationary brake ring positioned concentrically to the transport wheel, the transport containers alternately coupled to the brake ring and the transport disk; and support arms concentrically rotatably supported relative to the transport wheel, each support arm carrying one of the transport containers.

Accordingly, the present invention suggests that for the controlled transfer of transport containers the transport means is comprised of a continuously driven transport wheel and a brake ring that is arranged concentrically to this transport wheel, wherein the transport containers are alternately coupled to the transport wheel and the brake ring. Each transport container is connected to one of a plurality of support arms, which are concentrically arranged relative to the transport wheel and are rotatably supported.

Preferably, the transport wheel and the brake ring are positioned in the same plane and are spaced at a small distance from one another. The transport wheel is preferably driven about a vertical axis. The support arms are preferably Z-shaped and connected vertically above one another to a stationary shaft, whereby preferably the transport wheel is also rotatably connected to this shaft, i.e., the shaft and vertical axis coincide. The support arms are preferably individually rotatably supported at the shaft.

Advantageously, each support arm further comprises brake pistons, activated by a pressure medium, for coupling and decoupling the transport containers to and from the transport wheel and the brake ring. Each support arm preferably has a housing for accommodating the brake pistons. The brake pistons form pairs such that brake pistons of one pair are arranged opposite one another and are actuated together. Advantageously, the transport wheel is positioned between the brake pistons of one pair, and the brake ring is positioned between the brake pistons of the other pair. The housing for accommodating the brake pistons is preferably adjustably connected to the support arm. Preferably, each support arm comprises at least one damping member at a side thereof facing in the direction of rotation of the transport wheel. Expediently, the damping member is connected to the housing.

Each brake piston has a pressure chamber. The stationary shaft has supply bores and the support arm has a connecting bore. The supply bores communicate with the connecting bore of each support arm for supplying the pressure medium to the pressure chambers of the brake pistons.

Expediently, each support arm further comprises a control valve for controlling the supply of pressure medium to the pressure chambers, whereby each support arm has a control line connecting the connecting bore to the control valve. The control valve is preferably positioned inside the housing. Advantageously, the control valve comprises a control lever acting on a rotatably supported control disk that has a control surface and a spring for biasing the control disk.

The transport means further comprises abutments that are displaceable toward the control valve for switching the control valve. When the control lever is activated by the abutments, the control lever rotates the control disk together with the control surface against the bias of the spring thereby switching the control valve. The abutments are preferably controlled as a function of movements of the support arms and operating cycles of the loading station and the unloading station. Preferably, servo devices are provided whereby each abutment comprises an angular lever that has connected thereto one of the servo devices for controllably displacing the angular lever of the abutment. The angular lever preferably has an adjustable control element. Each servo device comprises a cylinder and a piston inserted into the cylinder, whereby the piston is activated by a pressure medium introduced into the cylinder from both ends.

In another embodiment of the present invention, the support arm has an abutment bar cooperating with the abutment.

Preferably, a first abutment is positioned at the loading station and a second abutment is positioned at the unloading station.

Advantageously, a third abutment is positioned before the first abutment in the direction of rotation of the transport wheel. Preferably a sensor for controlling the servo device that controls the first abutment is provided. The sensor is preferably positioned vertically above the brake ring.

A fourth abutment is preferably positioned before the second abutment in the direction of rotation of the transport wheel. A sensor for controlling the servo device that controls the second abutment is provided. The sensor is expediently positioned vertically above the brake ring.

In a further embodiment of the present invention, the support arm further comprises a registering bar for controlling the control valve. The control lever, when activated by the registering bar, rotates the control disk together with the control surface against the bias of the spring, thereby switching the control valve. Preferably, each control lever has a contacting roller that extends past the housing in a direction of rotation of the device. Each registering bar is comprised of a lever that is fixedly Connected to the support arm and extends past the housing in a direction counter to the direction of rotation of the transport wheel. The lever has a slanted portion for cooperating with a contacting roller of the control lever arranged at the support arm, viewed counter to the direction of rotation, adjacent to the support arm to which the lever is connected. Preferably, the lever is connected to the top of the housing.

In a preferred embodiment, the shaft and the support arms are provided with supply lines and connecting lines that communicate with one another for supplying the pressure medium to the pressure chambers of the brake pistons whereby a control valve is inserted into a common inlet line of one support arm before the pressure chambers of the brake pistons. Preferably, the control valve is positioned within the housing. Adjustable abutments of the transport means and/or registering bars at the support arms control and switch the control valve.

Expediently, the control valve is switched by a control surface provided at a control disk that is rotatably supported and displaceable against the force of a spring by the displaceable of the transport means abutment or the registering bar of the support arm in cooperation with a control lever of the control valve. The control lever has a contacting roller and extends in the direction of rotation past the housing.

The abutments of the transport means can easily be adjusted or displaced by the movement of the support arms or as a function of the operating cycles of the loading and/or unloading stations of the device.

This is preferably achieved by embodying the abutments in the form of an angular lever having preferably an adjustable control member and also a servo device, for example in the form of a cylinder containing a piston that is loaded from both ends by a pressure medium, with which the abutments are controllable and displaceable.

For safety reasons the support arms are additionally provided with abutment bars cooperating with the abutments.

The registering bars can be provided in the form of a lever that is fixedly connected to the support arm, preferably to its housing, which projects in the direction counter to the direction of rotation from the housing and has a slanted portion for activating the contacting roller of a control lever arranged at a support arm following, counter to the direction of rotation, the previous support arm with the lever.

It is furthermore advantageous to provide a first and a second abutment at the loading station and the unloading station, respectively, which in a more preferred embodiment have coordinated therewith a third, respectively, a fourth abutment arranged upstream of the first/second abutment.

In order to provide for an almost completely automated control of the transport device it is possible to arrange sensors, preferably vertically above the brake ring, for controlling the servo devices controlling the abutments at the loading and/or unloading station.

In order to prevent noise emissions when the support arms come in contact with one another, their end faces in the direction of rotation can be provided with at least one damping member which is preferably connected to the housing that accommodates the control valve and the brake pistons.

With a transport device according to the present invention, having a continuously driven transport wheel and a concentrically arranged brake ring to which the transport containers supported at rotatably supported support arms are alternately coupled by brake pistons activated by a pressure medium, an automated and continuous transfer cycle requiring only little handling by the operating personnel and providing for a gentle treatment of the goods to be transported, especially sausages, is provided. With the suggested transport device it is furthermore possible to compensate for differing working speeds of the different machines connected to one another by the transport device because the transport containers can be stored or parked before the unloading station. The transport device can thus act as a parking means for the packaging machine so that the packaging machine can be continuously operated even when the sausage filling machine is shut off in order to introduce new casings.

It is furthermore advantageous that the transport device has a high output and can be adapted to different products because the transport containers are easily exchangeable so that a high flexibility as well as a predictable capacity are provided. Furthermore, a hygienic handling of the sausages is ensured because the sausages must not be handled by operating personnel; no manual operations are required. The sausage production therefore can be fully automated from the filing machine to the packaging machine with little constructive expenditure.

The coupling of the transport containers to the rotating transport wheel as well as their braking by coupling to the brake ring is achieved by the brake pistons which are operated by a pressure medium so that the transport containers at the loading station as well as at the unloading station are exactly positioned and can also be slowly braked in a corresponding manner. The inventive transport device further almost completely eliminates noise emission, especially the noise emission caused by a sudden contacting of the transport containers or their sliding onto an abutment because the braking distance can be adjusted as a function of the pressure medium pressure or the switching time of the valves and can thus be adapted to the respective operating conditions, even with respect to the goods to be transported. Furthermore, with the aid of the registering bars connected to the support arms, advancing transport containers are automatically decoupled from the respective station if the station is occupied, and parked. In this manner, an optimal operation with a high operational reliability is ensured.

DESCRIPTION OF PREFERRED EMBODIMENTS

The present invention will now be described in detail with the aid of several specific embodiments utilizing FIGS. 1 through 6.

Figure 2:
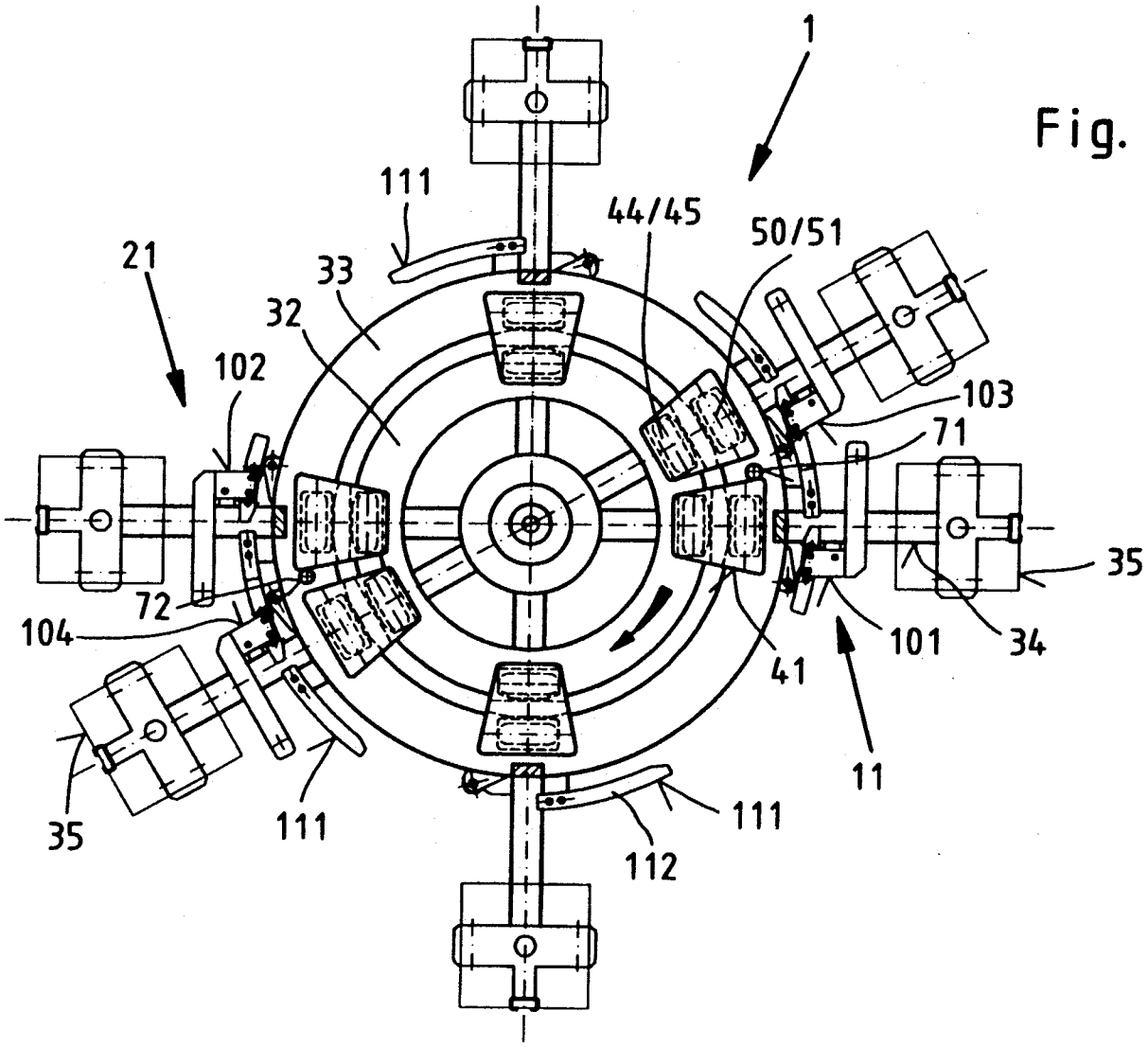
FIG. 2 shows the transport device of FIG. 1 in a plan view.

The inventive transport device 1 represented in FIGS. 1 and 2 serves to transfer transport containers 35 from a loading station 11 to an unloading station 21 in a controlled manner, for example, for transferring non-smoked (fresh) sausages 10 portioned and shaped in a sausage filling machine in an automated manner to a packaging machine 22. The transport containers 35 are loaded at the loading station 11 corresponding to the produced amount of sausages and unloaded at the unloading station 21 corresponding to the working cycle of the packaging machine 22 so that with the transport device 1 differing working cycles of the machines connected by the transport device can be compensated.

The loading station 11 in t he shown embodiment is comprised of a conveyor belt 12 supported on stays 13 and a lifting member 15 with which the sausages 10 are loaded into the transport container 35. The sausages 10 which are placed onto the conveyor belt 12 by a non-represented sausage filling machine are collected at an abutment 14. The lifting member 15 which is provided with a servo device 16 and which penetrates the conveyor belt 12 in a comb-like manner pushes the sausages into the transport container 35. The transport container 35 is comprised of two pivotably arranged half-shells. Above the lifting member 15 and the packaging machine 22 the transport containers 35 are opened against the bias of return springs by pivoting apart the two half-shells with the assistance of servo devices 36, 37.

Figure 3:
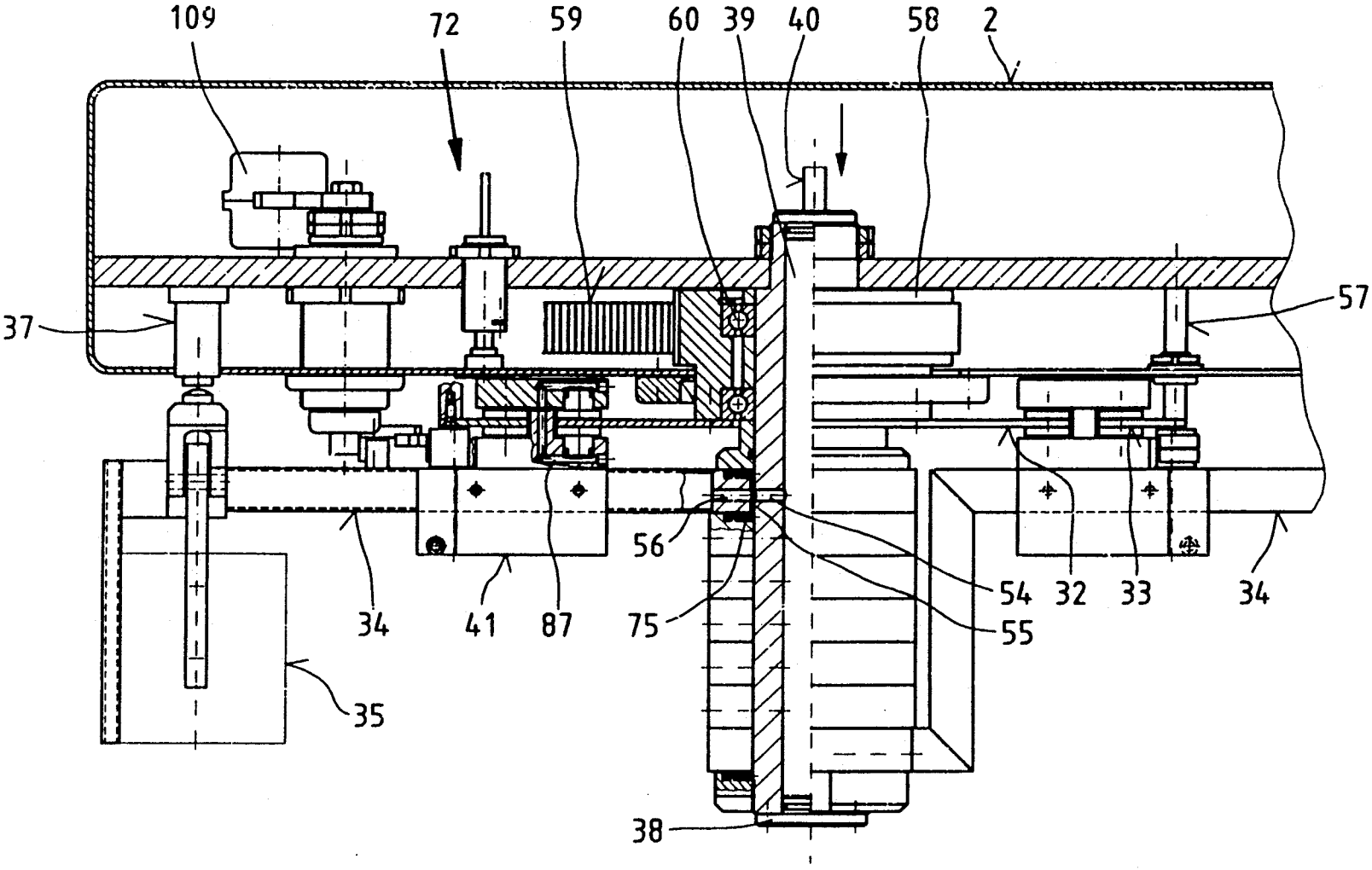
FIGS. 3 and 4 show details of FIG. 1 in an enlarged representation.
Figure 4:
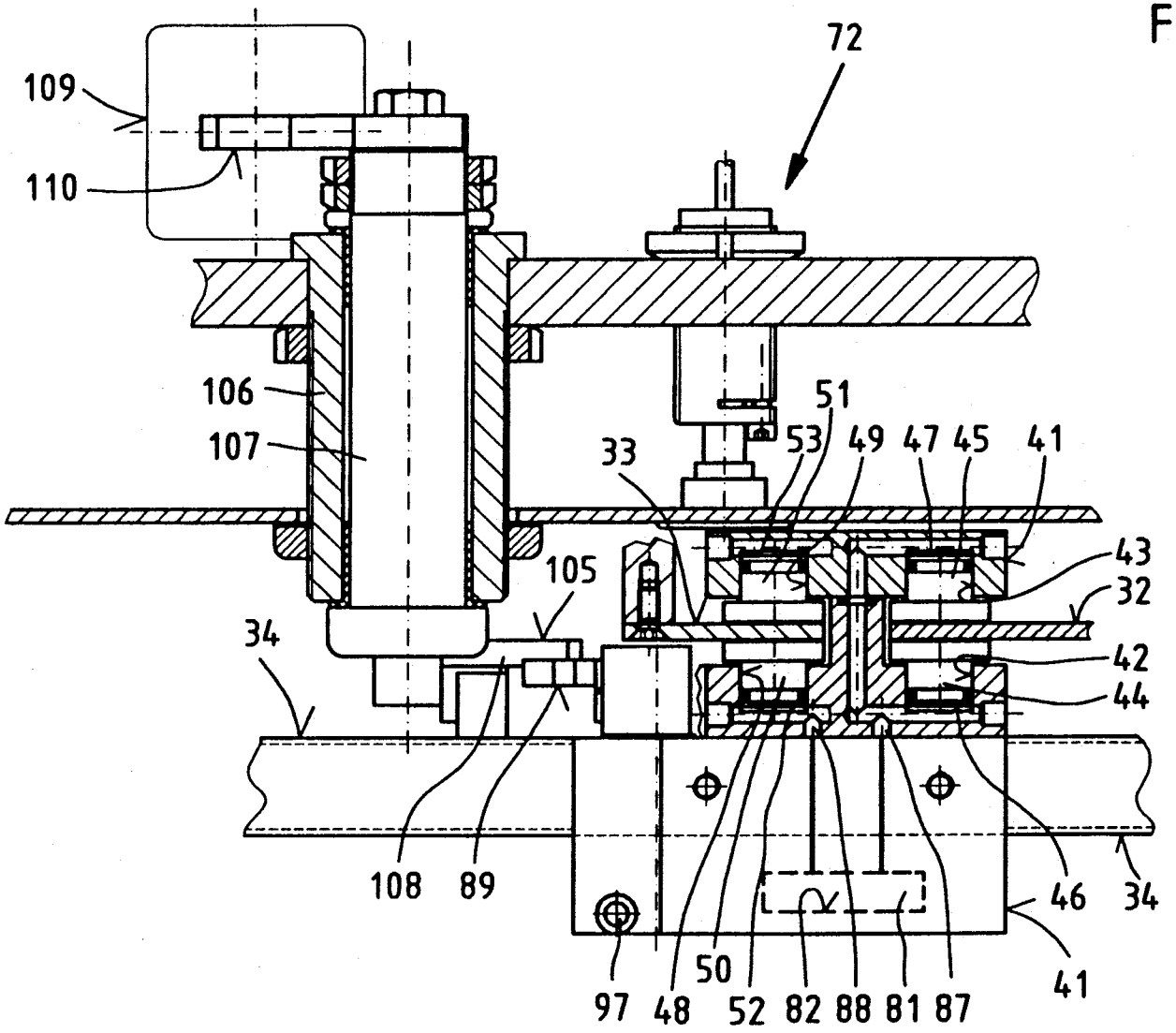

For transferring the transport containers 3 a transport means 31 is provided which is comprised of a continuously rotatably driven transport wheel 32 and a stationary brake ring 33 arranged concentrically to the transport wheel 32. The transport containers 35 are alternately coupled to the transport wheel 32 and the brake ring 33. The transport wheel 32, as can be seen especially in FIG. 3, is fixedly connected with a pulley 58 cooperating with a toothed belt 59 and rotatably supported by bearings 60 on a shaft 38. The shaft 38 is fixedly connected to an intermediate wall 3 of a machine frame 2 that supports the transport device 1. The energy required for driving the transport wheel 32 is provided by a non-represented drive motor via the toothed belt 59 and the pulley 58.

The transport containers 35 are connected to support arms 34, 34', 34'', etc. which are also supported in a rotatable manner at the shaft 38. In order to provide for a space-saving arrangement, the Z-shaped support arms 34, 34', 34'', etc. are supported on top of one another on roller bearings 75 in a vertically stacked arrangement. Each support arm 34, 34', 34'', etc. is furthermore provided with a housing 41 that is aligned in the longitudinal direction of the support arms 34, 34', 34'', etc. and accommodate pairs of brake pistons 44, 45 and 50, 51 between which the transport wheel 32 and the brake ring 33, both arranged in the same plane, are positioned. The brake pistons 44, 45, 50, 51 are inserted into bores 42, 43, 48, 49 provided in the housing 41 so that pressure chambers 46, 47, 52, 53 are formed in order to force the brake pistons 44, 45 and 50, 51 with a respective pressure medium alternately against the transport wheel 32, respectively, against the brake ring 33. The brake ring 33 is supported by a holder 57 at the intermediate wall 3 of the support frame 2.

In order to accomplish this, the shaft 38 has a longitudinal supply bore 39 which communicates with a pressure line 40 and transverse bores 54 which open into an annular groove 55. The support arms 34, 34', 34''etc. are provided with transverse bores 56 which communicate with the annular groove 55 so that pressure medium can be transferred continuously to the individual support arms 34, 34', 34'', etc.

Figure 6:
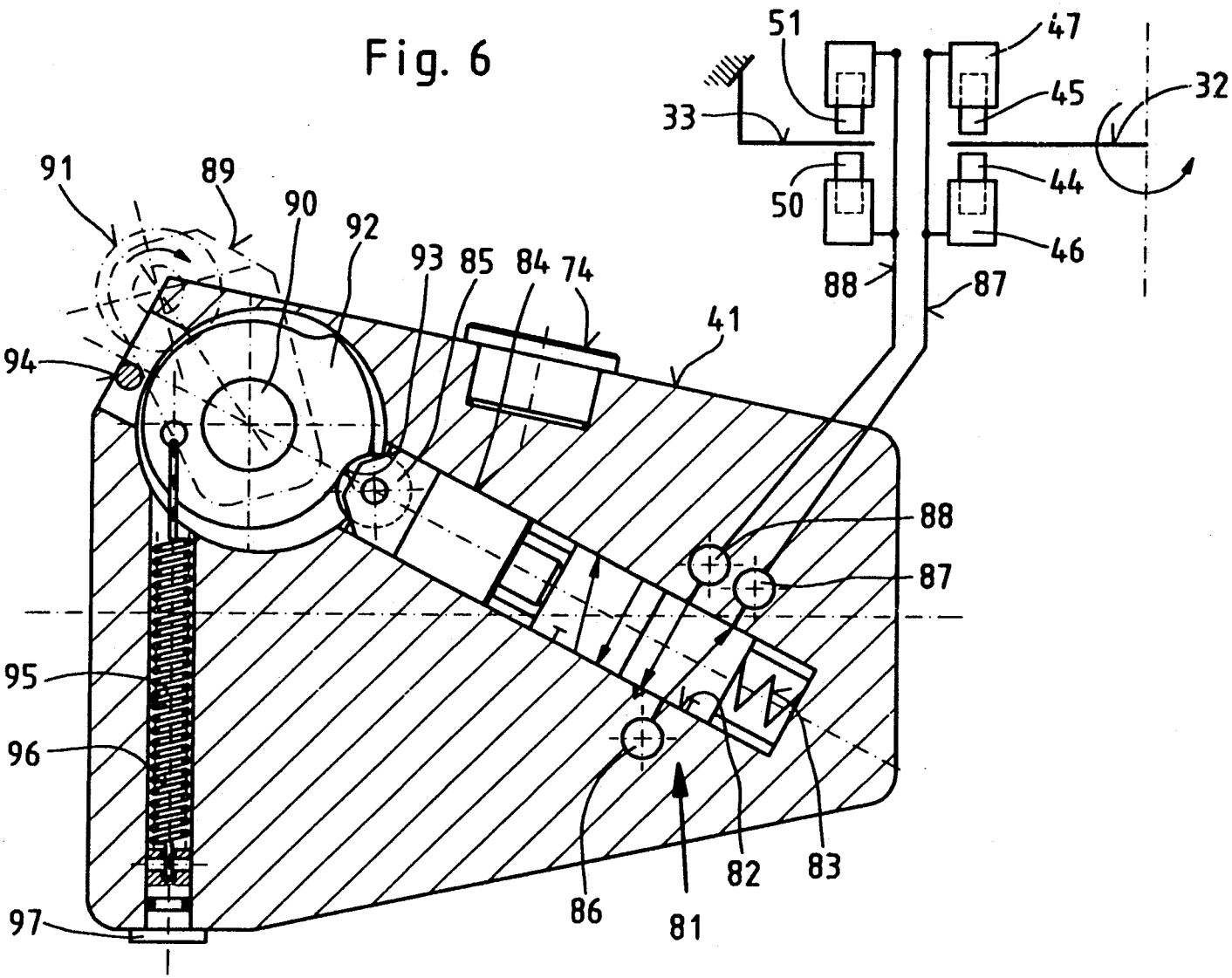
FIG. 6 shows a horizontal section of a housing containing the control valve and connected to the support arm and the schematic connection of the valve to the transport device.

For a controlled alternate supply of pressure medium to the pressure chambers 46, 47 of the brake piston 44, 45 or the pressure chambers 52, 53 of the brake pistons 50, 51 the housing 41 is provided with a control valve 81 which is inserted into a bore 82, see FIG. 6. The control valve 81 is in the form of a 5/2-way valve and via its control line 86, connected to the support arm 34, 34', 34'', etc., respectively, its bore 56, is connectable to the line 87 leading to the pressure chambers 46, 47 or to the line 88 connected to the pressure chambers 52, 53, depending on a switching position of the control valve 81 (see FIG. 6). The control valve 81 can be activated against the bias of a spring 83 with the aid of a plunger 84 inserted into the bore 82 which is adjustable by a rotatable control disk 92. The control disk 92 which has a control surface 93 is fixedly connected to a shaft 90 which is rotatably supported within the housing 41. The control disk 92 is rotatable by a control lever 89 that is also fixedly connected to the shaft 90. For returning the control lever 89 together with its a contacting roller 91 a tension spring 96 is provided which is arranged in a bore 95 sealed by a plug 97 and suspended between the plug 97 and the control disk 92.

When a force is exerted in FIG. 6, onto the contacting roller 91 in the direction of the arrow shown, the control lever 89 is rotated to the right if the acting force is greater than the force of the tension spring 96. Accordingly, the control disk 92 connected to the control lever 89 is rotated in the same direction and due to the control surface 93 which rests at the roller 85 of the plunger 84 the control plunger 84 is also displaced to the right so that the control valve 81 is switched. When the force no longer acts on the contacting roller 91, the control lever 89 is returned by the tension spring 96 into its initial position until it abuts at the abutment 94 so that the control valve 81 is returned by the force of the spring 83.

When the line 86 is connected to the line 87 the pressure chambers 46 and 47 of the brake pistons 44 and 45 are simultaneously supplied with pressure medium so that the respective support arm 34, 34', 34'', etc. is coupled to the transport wheel 32 by pressing the brake pistons 44, 45 onto the wheel 32. When the line 86 is connected to the line 88 pressure medium is supplied to the pressure chambers 52 and 53 of the brake pistons 50 and 51 and the corresponding support arm 34, 34', 34'', etc. in this case is parked by pressing the brake pistons 50 and 51 against the stationary brake ring 33.

In order to park the transport containers 35 in a desired position for loading and unloading, in the area of the loading station 11 a pivotable abutment 101 and in the area of the unloading station 21 a further pivotable abutment 102 are provided through which the control levers 89 extending past the housing 41 of the support arms 34, 34', 34'' are activated.

Figure 5:
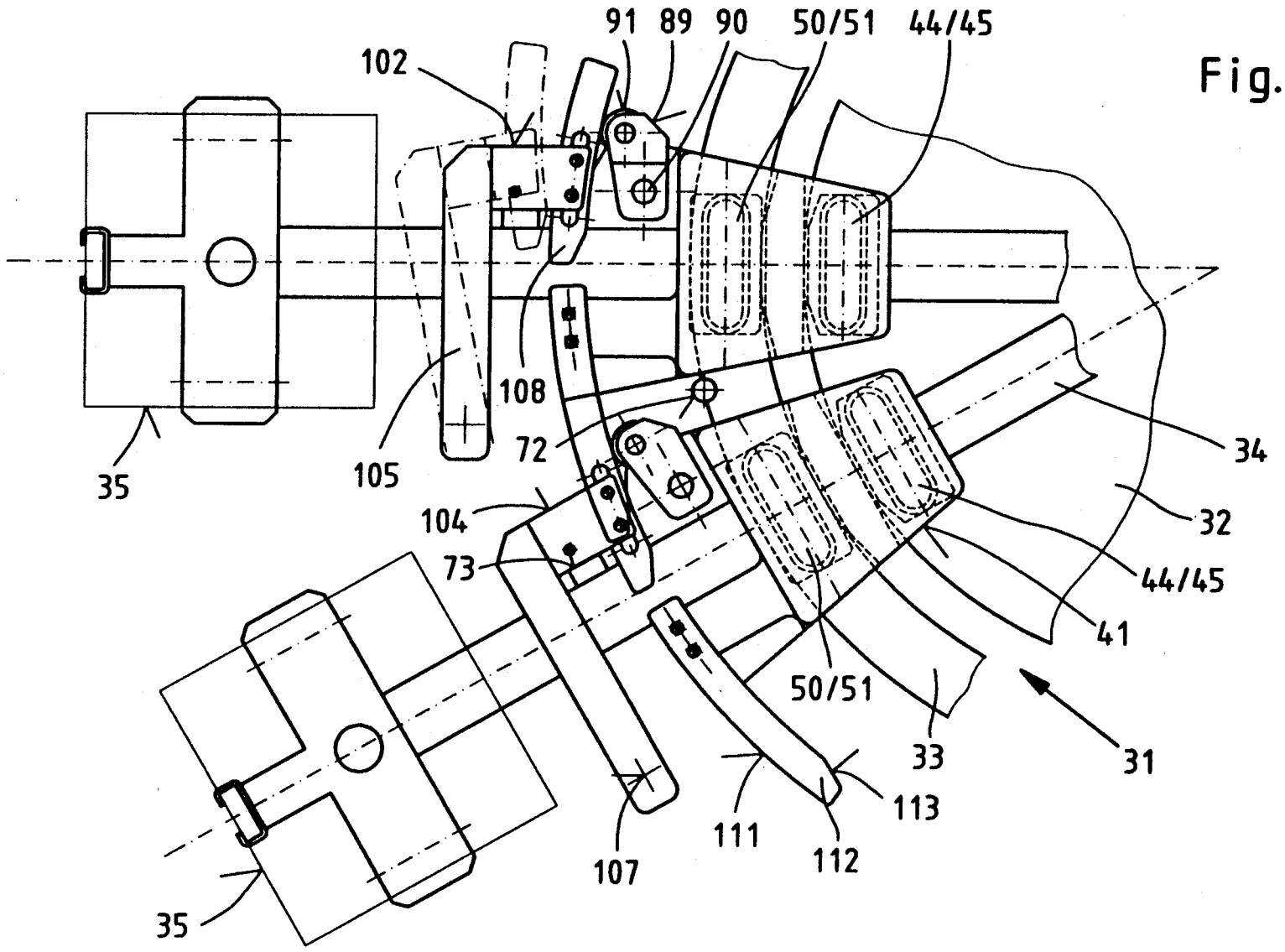
FIG. 5 shows a detail of FIG. 2 in an enlarged representation.

The abutments 101 and 102, as can be seen in FIGS. 2 and 5, are each comprised of a pivotably supported angular lever 105 that is connected to a rotatably supported shaft 107 positioned in a sleeve 106. The angular lever 105 is provided with a control member 108. The sleeves 106 are supported at the intermediate wall 3 of the support frame 2. On the side remote from the shaft 107 the angular lever 105 is provided with a further lever 110 onto which a servo device 109 acts. With the aid of the servo device 109 the angular lever 105 can be pivoted into its end position such that, due to the control member 108 cooperating with the contacting roller 91, the control lever 89 is pivoted and the control valve 81 is actuated.

In front of the abutments 101 and 102 in the area of the loading station 11 and the unloading station 21 sensors 71, respectively, 72 are provided with which the servo devices 109 that control the abutments 101 and 102 can be actuated as well as further abutments 103, respectively, 104, the further abutments 103, 104 embodied in the same manner as the aforementioned abutments 101 and 102. With the abutments 103 and 104 it is ensured that the arriving transport containers are parked in front of the loading station 11, respectively, the unloading station 12 at such a distance that the half-shells of the transport containers 35 can be opened without any obstruction being present.

In order to prevent the transport containers from sliding onto parked transport containers, a registering bar 111 is connected to each support arms 34, 34', 34'', etc. which is comprised of a rearwardly extending lever 112 provided with a slanted portion 113. The registering bar 111 also acts on the contacting roller 91 Of a following support arm 34, 34', 34'', etc. so that before a contacting of a parked transport container 35 takes place the connection of the following support arm to the transport wheel 32 is released and the transport container 35 is instead coupled to the brake ring 33 of the transport means 31.

When a support arm 34, 34', 34'', etc. connected to the transport wheel 32 is transported to the loading station 11 in the direction of the arrow (FIG. 2), the sensor 71 controls the servo device 109 of the abutment 101 such that it is pivoted into the displacement region of the control lever 89, and the transport container 35 is thereby parked in this position. The brake pistons 44 and 45 cooperating with the transport wheel 32 are thereby released from the wheel 32, while the brake pistons 50 and 51 are actuated and connected to the brake ring 33. A following support arm 34, 34', 34'', etc. is parked in the same manner with the aid of the pivoted abutment 103 so that without any obstruction a loading can be performed at the loading station 11.

Upon completion of filling of the transport container 35 a signal is sent to the servo device 109 and the angular lever 105 of the abutment 101 is outwardly pivoted so that the transport container filled with sausages 10, respectively, its support arm is coupled to the transport wheel 32 and transferred to the unloading station 21 because the control valve 81 is automatically switched. Simultaneously, the transport container parked at the loading station 11 is again connected to the transport wheel 32, because the abutment 103 is pivoted, and advanced to the loading station 11. By passing the sensor 71 the angular lever 105 of the abutment 101 is again inwardly pivoted so that the following support arm is decoupled from the transport wheel 32 at the loading station 11 in the aforedescribed manner.

At the unloading station 21 the arriving support arm is decoupled from the transport wheel 32 at the prescribed location with the aid of the sensor 72 so that the goods in the transport container 35 can be transferred to the packaging machine 22. A following support arm is parked with the aid of the abutment 104, which is also controllable as a function of the signals received by the sensor 72, at a distance from the unloading station 21 and can only be advanced when the previous transport container has been removed.

In order to be able to brake a remaining movement of the support arms 34, 34', 34'', etc. the support arms are provided with abutment bars which cooperate with the angular levers 105 of the abutments 101 to 104. Furthermore, the end faces of the housing 41 facing in the direction of rotation are provided with damping members 74 for additionally damping the impact upon contacting of the housings 41.

The present invention is, of course, in no way restricted to the specific disclosure of the specification and drawings, but also encompasses any modifications within the scope of the appended claims.

What we claim is:

1. A transport device for transferring transport containers in a controlled manner from a loading station to an unloading station, said device comprising:

a transport means for transporting the transport containers between the loading station and the unloading station, wherein the transport containers are controllably connected to said transport means, said transport means comprising a continuously rotatably driven transport wheel and a stationary brake ring positioned concentrically to said transport wheel, the transport containers alternately coupled to said brake ring and said transport wheel; and support arms concentrically rotatably supported relative to said transport wheel, each said support arm carrying one of the transport containers.

2. A device according to claim 1, wherein said transport wheel and said brake ring are positioned in a same plane and are spaced at a small distance to one another.

3. A device according to claim 1, wherein said transport wheel has a vertical axis and is driven about said vertical axis.

4. A device according to claim 3, wherein:

said transport means further comprises a stationary shaft; and said support arms are individually rotatably connected to said stationary shaft in a vertically stacked arrangement.

5. A device according to claim 4, wherein said support arms are Z-shaped.

6. A device according to claim 4, wherein said vertical axis coincides with said stationary shaft and said transport wheel is rotatably connected to said shaft.

7. A device according to claim 4, wherein each said support arm further comprises brake pistons, actuated by a pressure medium, for coupling the transport containers to said transport wheel and said brake ring.

8. A device according to claim 7, wherein:

each said support arm has a housing for accommodating said brake pistons; and said brake pistons form pairs such that said brake pistons of one said pair are arranged opposite one another and are actuated together.

9. A device according to claim 8, wherein said transport wheel is positioned between said brake pistons of one said pair.

10. A device according to claim 8, wherein said brake ring is positioned between said brake pistons of one said pair.

11. A device according to claim 8, wherein said housing is adjustably connected to said support arm.

12. A device according to claim 8, wherein each said support arm comprises at least one damping member at a side thereof facing in a direction of rotation of said transport wheel.

13. A device according to claim 12, wherein said damping member is connected to said housing.

14. A device according to claim 8, wherein:

each said brake piston has a pressure chamber;

said stationary shaft has supply bores;

each said support arm has a connecting bore;

said supply bores communicating with said connecting bore of each said support arm for supplying the pressure medium to said pressure chambers.

15. A device according to claim 14, wherein:

each said support arm further comprises a control valve for controlling the supply of pressure medium to said pressure chambers; and each said support arm has a control line connecting said connecting bore to said control valve.

16. A device according to claim 15 wherein said control valve is connected inside said housing.

17. A device according to claim 15, wherein said control valve comprises:

a control lever;

a rotatably supported control disk having a control surface; and a spring biasing said control disk.

18. A device according to claim 17, wherein said transport means further comprises abutments, displaceable toward said control valve, for controlling said control valve.

19. A device according to claim 18, wherein said control lever, when activated by said abutments, rotates said control disk and said control surface against the bias of said spring, thereby switching said control valve.

20. A device according to claim 18, wherein said abutments are controlled as a function of movements of said support arms and operating cycles of the loading station and the unloading station.

21. A device according to claim 18, further comprising servo devices, wherein each said abutment comprises an angular lever having connected thereto one said servo device for controllably displacing said angular lever of said abutment.

22. A device according to claim 21 wherein said angular lever has an adjustable control element.

23. A device according to claim 21, wherein each said servo device comprises a cylinder and a piston inserted in said cylinder, said piston activated by a pressure medium introduced into said cylinder from both ends.

24. A device according to claim 18, wherein each said support arm has an abutment bar cooperating with said abutment.

25. A device according to claim 21, wherein a first said abutment is positioned at the loading the unloading station.

26. A device according to claim 25, wherein a third said abutment is positioned before said first abutment in a direction of rotation of said transport wheel.

27. A device according to claim 25, further comprising a sensor for controlling said servo device controlling said first abutment.

28. A device according to claim 27, wherein said sensor is positioned vertically above said brake ring.

29. A device according to claim 25, wherein a fourth said abutment is positioned before said second abutment in a direction of rotation of said transport wheel.

30. A device according to claim 25, further comprising a sensor for controlling said servo device controlling said second abutment.

31. A device according to claim 30, wherein said sensor is positioned vertically above said brake ring.

32. A device according to claim 17, wherein each said support arm further comprises a registering bar for controlling said control valve.

33. A device according to claim 32, wherein said control lever, when activated by said registering bar, rotates said control disk and id control surface against the bias of said spring, thereby switching said control valve.

34. A device according to claim 32, wherein:

each said control lever has a contacting roller and extends past said housing in a direction of rotation of said transport wheel; and each said registering bar is comprised of a lever fixedly connected to said support arm and extending past said housing in a direction counter to a direction of rotation of said transport wheel, said lever having a slanted portion for cooperating with one said contacting roller of one said control lever of one said support arm adjacent to said support arm said lever is connected to.

35. A device according to claim 34, wherein said lever is connected to the top of said housing.

36. A device according to claim 17, wherein said control lever has a contacting roller and extends past said housing in a direction of rotation of said transport wheel.

* * * * *